US009017127B1

(12) United States Patent
Callahan et al.

(10) Patent No.: US 9,017,127 B1
(45) Date of Patent: Apr. 28, 2015

(54) RECREATIONAL BUOYANCY SYSTEM

(71) Applicants: Brian A. Callahan, Wauwatosa, WI (US); Daniel P. McGinley, Menomonee Falls, WI (US)

(72) Inventors: Brian A. Callahan, Wauwatosa, WI (US); Daniel P. McGinley, Menomonee Falls, WI (US)

(73) Assignee: H2OChills, LLC, Wauwatosa, WI (US)

( * ) Notice: Subject to any disclaimer, the term of this patent is extended or adjusted under 35 U.S.C. 154(b) by 214 days.

(21) Appl. No.: 13/644,292

(22) Filed: Oct. 4, 2012

Related U.S. Application Data

(60) Provisional application No. 61/542,975, filed on Oct. 4, 2011.

(51) Int. Cl.
*B63C 9/08* (2006.01)
*B63C 9/28* (2006.01)
*B63B 35/74* (2006.01)

(52) U.S. Cl.
CPC ..... *B63B 35/74* (2013.01)

(58) Field of Classification Search
CPC ..... B63B 35/74; B63B 35/76; B63B 35/78
USPC ..... 441/129–132
See application file for complete search history.

(56) References Cited

U.S. PATENT DOCUMENTS 2,859,458 A * 11/1958 Calarco ..... 441/44
4,804,177 A * 2/1989 Rosson ..... 482/55
4,861,300 A * 8/1989 Casagrande et al. ..... 441/81
5,058,522 A 10/1991 Bauer
5,171,178 A 12/1992 Creek et al.
5,358,438 A 10/1994 Wolfe
5,441,006 A * 8/1995 Wood ..... 114/220
5,562,514 A * 10/1996 Rowe ..... 441/130
5,571,036 A 11/1996 Hannigan
5,779,513 A * 7/1998 Burton et al. ..... 441/129
5,885,123 A * 3/1999 Clifford ..... 441/129
6,045,423 A * 4/2000 Silvia ..... 441/132
6,056,613 A * 5/2000 Pike ..... 441/129
6,062,930 A * 5/2000 Smith ..... 441/129
6,213,832 B1 * 4/2001 Fest, Sr. ..... 441/129
6,227,925 B1 5/2001 Boddy
6,276,979 B1 8/2001 Saltel et al.
6,311,343 B1 11/2001 Wisniewski
6,786,786 B1 * 9/2004 Davis ..... 441/120
6,837,765 B2 * 1/2005 Lauziere ..... 441/130
6,908,353 B2 * 6/2005 Zheng ..... 441/131
7,207,857 B2 * 4/2007 Zheng ..... 441/130

(Continued)

OTHER PUBLICATIONS

Aqua Swing Unsinkable Sling Chair; www.bizrate.com/aqua-swing-unsinkable-sling-chair-2518939901/shop; printed Jul. 20, 2012.

(Continued)

*Primary Examiner* — Daniel V Venne
(74) *Attorney, Agent, or Firm* — Boyle Fredrickson, S.C.

(57) ABSTRACT

A recreational buoyancy system is provided that includes multiple floats and a user support that engages and conforms to a shape of a body of a user. The user support may include an intermediate portion and multiple arms that extend from the intermediate portion in different directions toward outer ends of the multiple arms. Multiple floats are arranged at the outer ends of the multiple arms, respectively. The user support may be made from a flexible material so that the user support can conform to the body of the user while the multiple floats buoyantly support the user in the water at the spaced-apart locations while allowing the multiple floats to move relative to each other.

15 Claims, 5 Drawing Sheets

(56) References Cited

U.S. PATENT DOCUMENTS

| | | | | |
|---|---|---|---|---|
| 7,571,965 | B1 | 8/2009 | Perry | |
| D636,452 | S * | 4/2011 | Majors | D21/803 |
| 7,998,031 | B2 | 8/2011 | Dumke et al. | |
| 8,137,031 | B2 * | 3/2012 | Meyers et al. | 405/215 |

OTHER PUBLICATIONS

Sling Ball Pool Toy; www.toysplash.com/Product/SlingBallPoolToy; printed Jul. 20, 2012.
Pool Toy; www.pooltoy.com; printed Jul. 20, 2012.
Super Soft Adjustable Recliner; www.pooltoy.com/susoadre.html; printer Jul. 19, 2012.
Captiva Lounge; www.pooltoy.som/calobysw.html; printed Jul. 19, 2012.
Super Soft Float; www.pooltoy.com/rivfloatloung.html; printed Jul. 19, 2012.
Swimline Solstice AquaSofa Lounger; www.pooltoy.com/swsoaglo.html; printed Jul. 19, 2012.
Solstice Pillow Top Mattress; www.pooltoy.com/sopitopma.html; printed Jul. 19, 2012.
Cannon Ball; www.pool-toy-warehouse.com/product__71__the__cannon__ball.html; printed Jul. 19, 2012.
Body Bobber; www.bodybobber.com/index-.php; printed Jul. 19, 2012.
Aqua Swing; www.homedecorators.com/detail.php?parentid=05737&aid=google.push&gclid-CL . . . ; printed Jul. 19, 2012.
Lifesling2 Rescue Sling; www.defender.com/product.jsp?path=-1|135|303330|10437&id=10438; printed Jul. 19, 2012.
Aqua Saddle; www.sportinggoodscentral.com/pool-furniture/spongex-nt1082-aqua-saddle . . . ; printed Jul. 19, 2012.
Water Mat; www.pooltoy.con/watermat.html; printed Jul. 19, 2012.

* cited by examiner

RECREATIONAL BUOYANCY SYSTEM

CROSS REFERENCE TO RELATED APPLICATIONS

This application claims priority from U.S. Provisional Patent Application Ser. No. 61/542,975, filed on Oct. 4, 2011, the entirety of which is expressly incorporated by reference herein.

FIELD OF THE INVENTION

The present invention relates generally to flotation devices and, in particular, to a recreational buoyancy system that can support a user during water recreational activities.

BACKGROUND OF THE INVENTION

Recreational flotation and buoyancy devices are known for use with water recreational activities. Mattress-like floats that are filled with air are known, which allow users to float on top of the water. Other known devices are foam-based. Chairs or seats that are mounted to or made entirely from foam allow users to float upon the water. Other foam-based devices, such as foam tubes which are sometimes called "noodles" are known. Users of foam tubes can float by holding on to the foam tubes.

SUMMARY OF THE INVENTION

The present inventors have recognized that known flotation devices may be highly restrictive to movements of the users. The inventors have recognized that holding onto foam tube-type floatation devices may substantially decrease how much users may move their hands and/or arms. The present inventors have also recognized that other known flotation devices such as chairs and mattress-like floats tend to require users to conform their bodies to fit the particular configurations of the devices. For example, users must position their bodies upon these known devices by lying down on or sitting in the flotation devices, so that their bodies are adjusted to accommodate the shape(s) of the floatation devices. Doing otherwise, for example, when users lean too far over such floatation devices, the users tend to fall off or out of these known flotation devices. The present inventors have recognized that known recreational flotation and buoyancy devices ("flotation devices") tend to leave large portions of the users' bodies out of the water, which may expose the users to the temperature of the air and direct exposure to the sunlight. Therefore, the present invention contemplates a recreational buoyancy system that may address some of these and/or other inventor-identified problems and drawbacks of the prior art.

The user support may include an upper layer and a lower layer, each of which may be made from a flexible material, the upper layer including an upper surface that engages the body of the user and an opposing lower surface, the lower layer including an upper surface that abuts the lower surface of the upper layer and an opposing lower surface that faces away from the user. The material of the upper and lower layers of the user support may be flat in cross-section and can bend along multiple axes so as to conform to the body of the user. The arms of the user support may include pockets that hold respective floats. At each of the pockets, at least portions of the upper and lower layers of the user support are spaced from each other at the pocket to define a space therebetween and the respective float may be arranged within the space between the upper and lower layers of the user support at the pocket.

This may allow for a simple construction that can be quickly disassembled and allow for easy transportation.

The floats may have a variable volume for changing the size of the float and the floats may be spherical and pneumatically inflatable, which may allow for adjusting buoyancy of the system. This may be done with an air inlet at the floats for receiving air to increase the size of the float. Each pocket may include an opening that can be aligned with the air inlet of the respective float for permitting access to the air inlet. A flap may overlie and selectively restrict access to the opening of the pocket. The user support may be relatively less buoyant than the multiple floats so that the user support hangs below the multiple floats. This may allow the recreational buoyancy system to buoyantly support a user with substantially the entire body of the user under water, for example, with the user's neck and head being above water. This may allow the user to avoid exposure to hot air and direct sunlight.

In accordance with another aspect of the invention, a loop that can be grasped by a hand of the user may be arranged at one of the pockets. Multiple loops may be arranged at outer portions of the pockets so that each float may be arranged between the respective loop and arm of the user support, which may allow the loops to be grasped by hand(s) of the user for repositioning the floats with respect to the body of the user without requiring the user to actively hold the entire system, and the user's movement is substantially not restricted as a function of the shape of the device. This may allow the user to move freely, for example, allow for substantially full movements of the user's limbs, while being passively buoyantly supported by the system.

In accordance with another aspect of the invention, the system includes a user support that engages and conforms to the shape of the body of a user. Multiple floats are provided that are connected to the user support and that are spaced from each other. This may allow the spaced-apart floats to serve as buoyant anchors that suspend the user in the water so that the user's neck and head remain above the water.

In accordance with another aspect of the invention, the user support may have multiple components that are detachably connected to each other. The user support may include a tether that extends between and connects a pair of floats to each other. The user support may include multiple tethers that are attached to each other or a sling that has a first end that is removably attached to the tether and a second end that is attached to another float. This may provide a Y-shaped or T-shaped profile to the user support that is defined by the tether and sling, in combination, that can cradle a body of the user in a variety of ways. According to one aspect, the tether may be used on its own and may support an upper body of the user with the pair of floats that are provided at the ends of the tether. According to another aspect, the tether and sling may be used together, whereby the tether and its pair of floats may support the upper body of the user and the sling may support the lower body of the user.

In accordance with another aspect of the invention, the user support may be made from a stretchable fabric. The fabric may be made from a nylon, spandex, polyester, and/or other synthetic blended woven or non-woven material. The flexible fabric or other material from which the user support is made may allow the user support to readily conform to the shape of the body of the user. This may allow a user to move within the water while the user support dynamically cradles the user, continuously re-conforming its shape to accommodate body movement of the user. At the same time, the user's neck and head are maintained above the water while the rest of the user's body is buoyantly suspended in the water from the floats by way of the user support.

Figure 1:
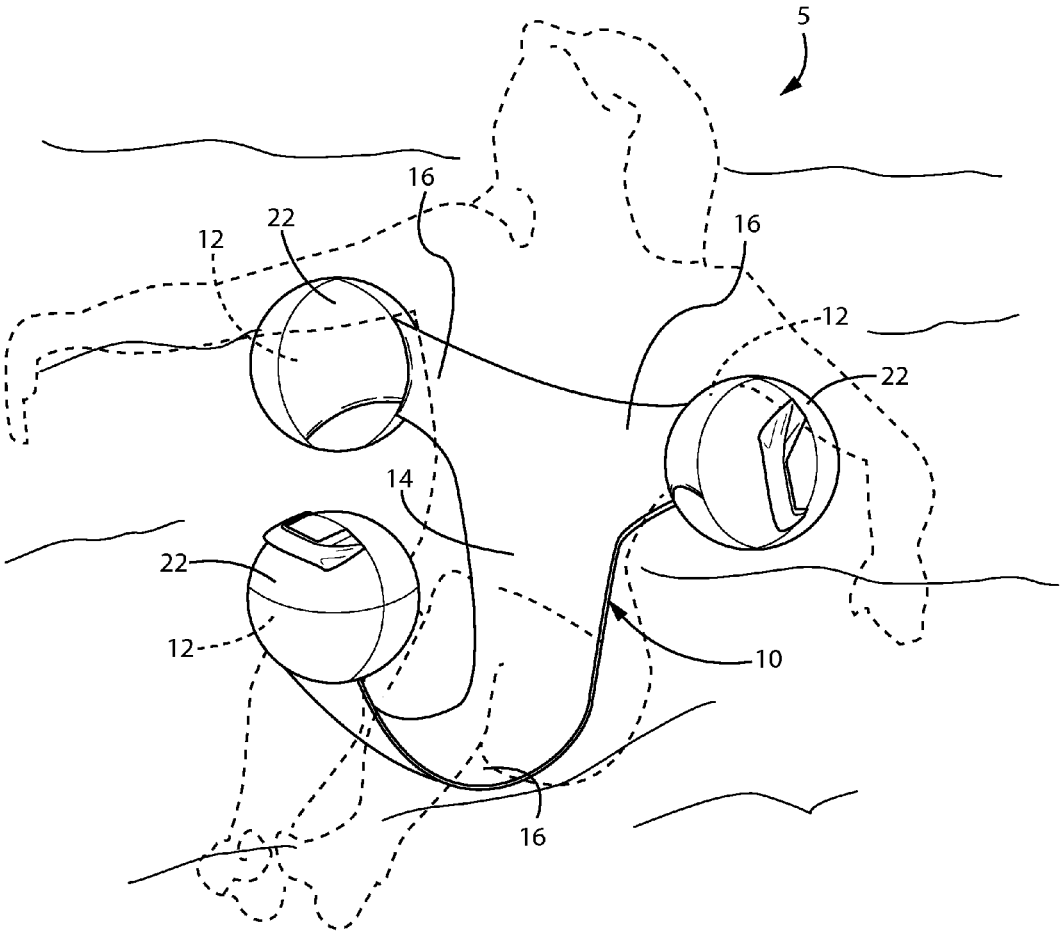
FIG. 1 is a perspective and partially schematic view of a recreational buoyancy system of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, recreational buoyancy system 5 is provided that can buoyantly suspend a user underwater, with the user's neck and head being above water. This is done with a user support 10 that conforms to a shape of a body of the user, and which may include a relatively small number of discrete floats 12 that are connected to the user support 10. The discrete floats 12 define spaced-apart floating anchors from which the user support 10 and thus the user are suspended under water, allowing the user to freely move while being passively buoyantly supported in the water while allowing the multiple floats to move relative to each other so as to passively reposition themselves about a center of gravity of the user for buoyant support, as described in greater detail elsewhere herein.

Figure 2:
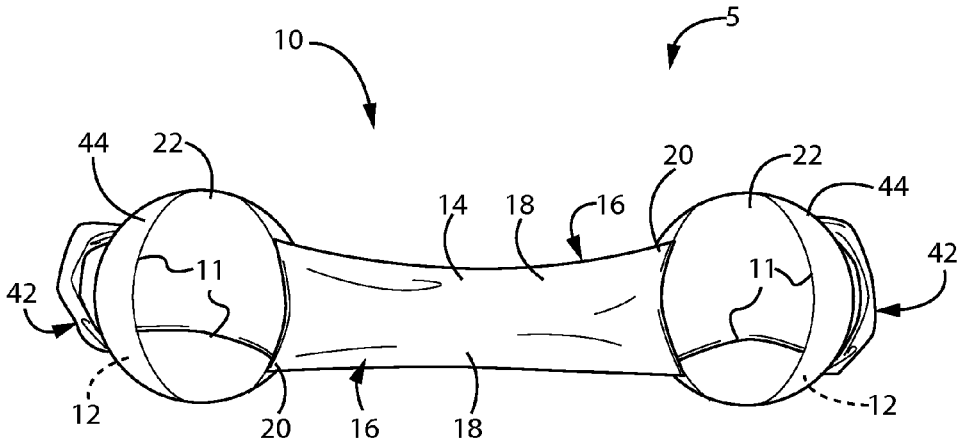
FIG. 2 is a top plan view of a variant the recreational buoyancy system of FIG. 1.
Figure 3:
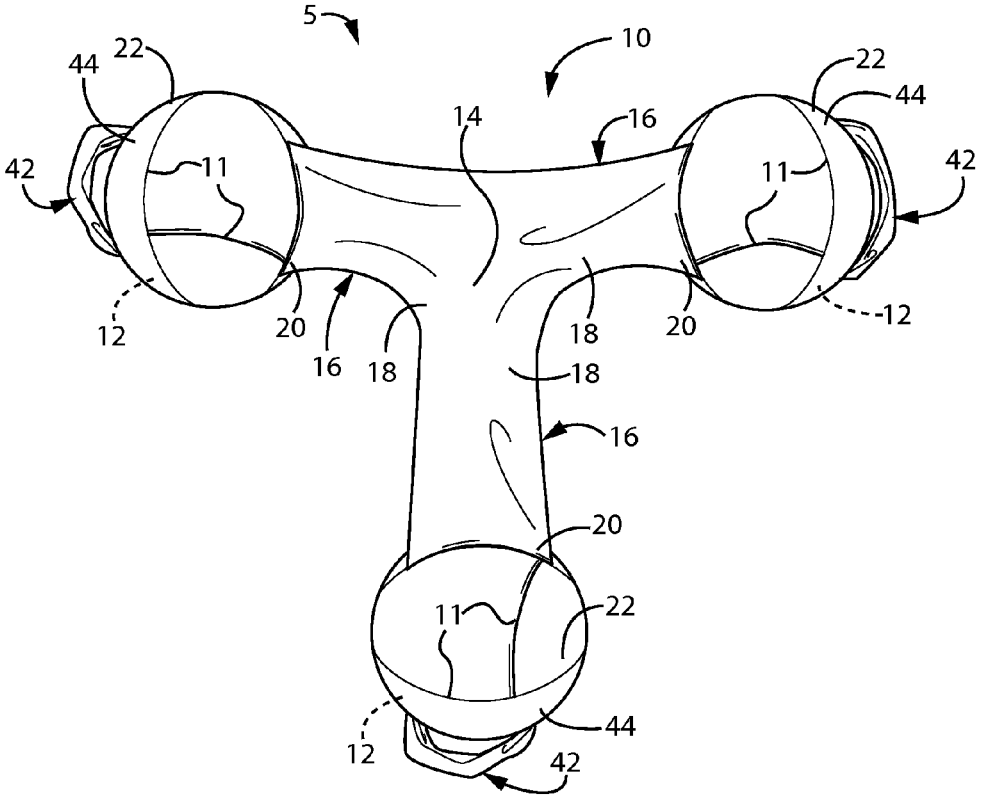
FIG. 3 is a top plan view of the recreational buoyancy system of FIG. 1.
Figure 6:
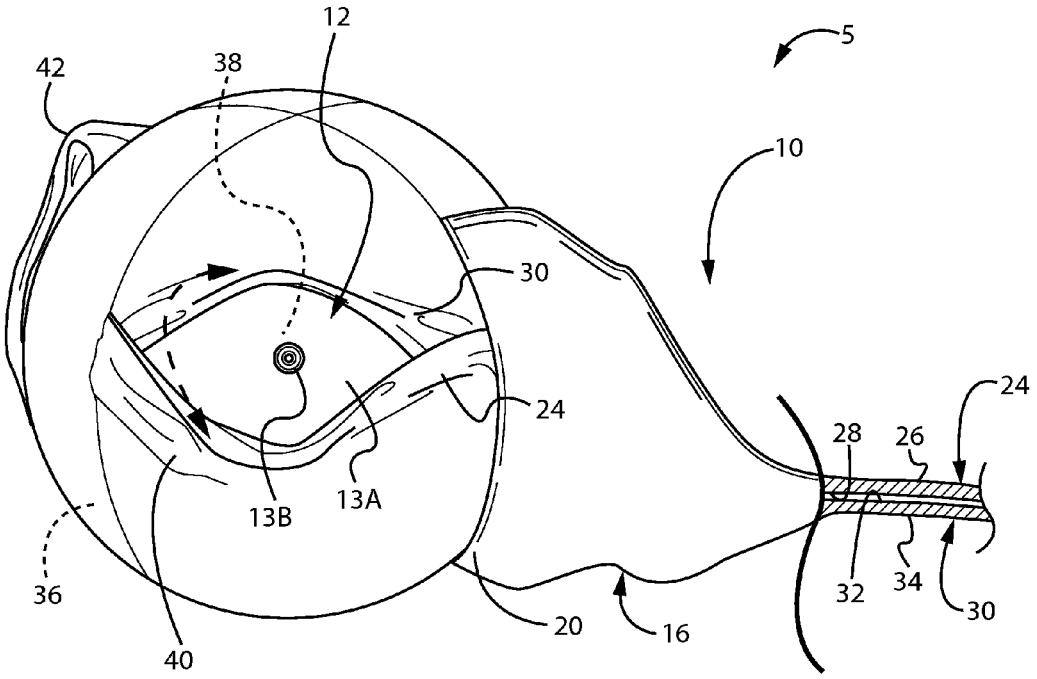
FIG. 6 is a close-up side elevation view of a portion of the recreational buoyancy system of FIG. 1.

Referring now to FIGS. 2 and 3, the floats 12 in these embodiments have ball-type configurations and are therefore spherical, although it is understood that the floats 12 may have other shapes. For example, at least one of the floats 12 may be pillow-shaped so as to define a generally round, triangular, rectangular, or other shaped perimeter and which be at least somewhat flat in profile and may include curved contours at one or more surface(s) of the float 12 for accommodating and supporting a head or other body part of the user. Each of the floats 12 may have a variable volume for changing size of the float, and may be pneumatically inflatable, which may allow for adjusting buoyancy of the system and for deflating and collapsing the floats 12 when the system 5 is not in use. As shown in FIG. 6, in this embodiment, the floats 12 have substantially flexible polymeric or elastomeric sidewalls 13A and valves or air inlets 13B, which allow for inflating and deflating the floats 12 using known pumps and inflating needles. In another embodiment, the floats 12 are not pneumatically inflatable but are instead made from a foam material or other material that has a density that is less than the density of water so as to be buoyant.

Referring again to FIGS. 2 and 3, the user support 10 includes an intermediate portion 14 and multiple arms 16 that extend from the intermediate portion 14 in different directions. The arms 16 include inner ends 18 and outer ends 20. Pockets 22 may be arranged at the outer ends 20 of the arms 16 for holding the floats 12. Referring to FIG. 2, in this embodiment, the user support 10 defines a generally rectangular or straight perimeter that is defined by a pair of opposing arms 16 extending away from the intermediate portion 14 and each other toward the respective pair of floats 12. As shown in FIG. 3, in this embodiment, the user support 10 defines a Y-shaped or T-shaped perimeter defined by the arms 16 extending away from the intermediate portion 14 and each other toward the respective three floats 12. In this embodiment, the intermediate portion 14 is not positioned equally between all of the floats 12. Instead, the intermediate portion 14 is closer to the pair of floats 12 shown toward the top of FIG. 3 and further from the float 12 shown at the bottom of FIG. 3. The arms 16 for the top of the user support 10 are relatively shorter than the arms 16 extending toward the bottom of the user support 10, as shown in FIG. 3. It is understood that the user support 10 may define other perimeter shapes, such as an X-shaped perimeter defined by four arms 16 extending away from the intermediate portion 14 and each other toward four floats 12 or other perimeter shapes.

As shown in FIG. 6, the user support may be made from multiple layers, shown here as including an upper layer 24 and a lower layer 30. Upper layer 24 is flat in cross-section and can bend along multiple axes so as to conform to the body of the user. The upper layer 24 has opposing upper and lower surfaces 26, 28. A lower layer 30 is arranged below the upper layer and is flat in cross-section and can bend along multiple axes so as to conform to the body of the user. The lower layer 30 has opposing upper and lower surfaces 32, 34. Upper surface 26 of the upper layer 24 is arranged to engage the body of the user. The lower surface 34 of the lower layer 30 faces away from the body of the user. The lower surface 28 of the upper layer 24 abuts the upper surface 32 of the lower layer 30, while the upper and lower layers 24, 30 can move with respect to each other by sliding and/or separation. The upper and lower layers 24, 30 may be defined by a single piece of material that is folded over itself and joined at respective edges. Thus the user support 10 may be made from a flexible material, for example, one or more panels of material that may be folded and/or sewn together at stitch lines or seams 11 to arrive at the complete assemblage of the user support 10. In one embodiment, the flexible material is a fabric that, preferably, is also stretchy. The fabric may be made from a nylon, spandex, polyester, and/or other synthetic blended woven or non-woven material. Regardless of what particular material user support 10 is made from, the material is sufficiently flexible to substantially cradle or conform to the shape of a body of the user, in a hammock-like manner. The material is also sufficiently flexible to allow free movement of the user's body so as to continuously re-conform its shape to accommodate body movement of the user.

Still referring to FIG. 6, the pockets 22 are defined by portions of the outer ends 20 of the arms 16 at which the upper and lower layers 24, 30 extend away from each other so as to provide spaces 36 in which the floats 12 are arranged. Each pocket 22 includes an opening 38 that can be selectively opened and closed and aligned with the air inlet of the respective float for permitting access to the air inlet 13B and for inserting and removing the deflated floats 12 into and out from the pockets 22. A flap 40 may provide the selective access to the interior of the pocket 22. The flap 40 may be defined by a portion of the upper layer 24 that overlies but is not connected to a portion of the lower layer 30 so that the flap 40 may be pulled aside across and over the lower layer 30 to reveal the opening 38. FIG. 6 shows the flap 40 as being pulled away from the lower layer 30, exposing the opening 38 through the pocket 22.

Referring again to FIGS. 2 and 3, loops 42 that are sized to accept a user's fingers and/or hand to allow the loops 42 to be grasped by user are arranged at outer portions 44 of the pockets 22. In this way, each float 12 is arranged between the respective loop 42 and arm 16 of the user support 10.

Figure 4:
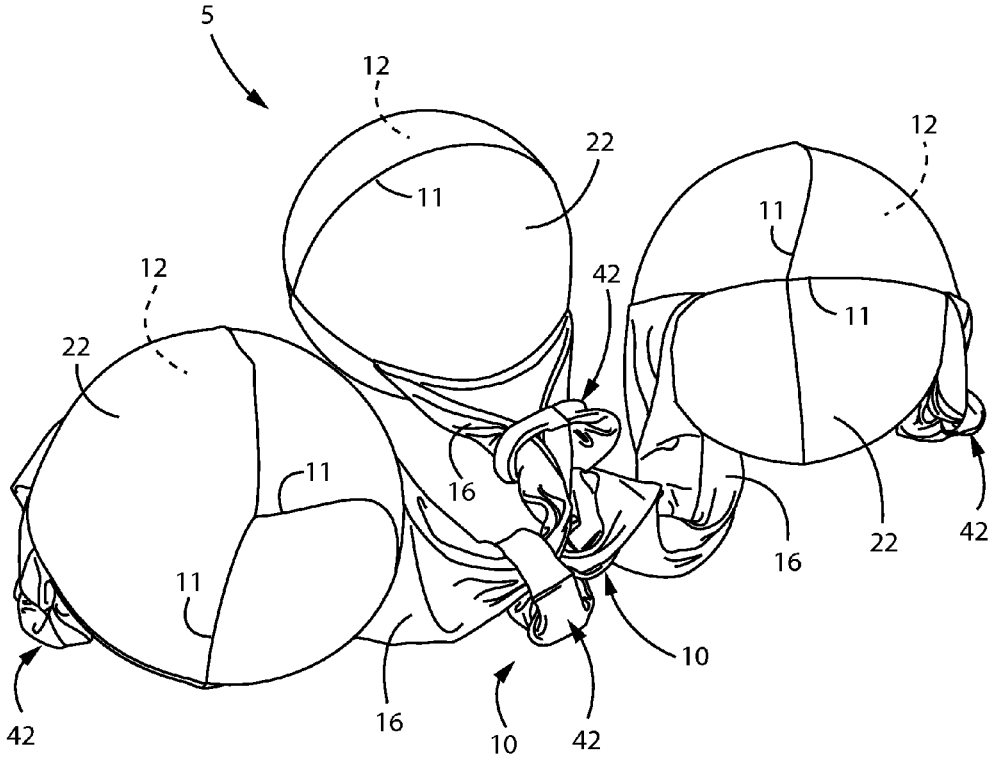
FIG. 4 is a perspective view of a variant of the recreational buoyancy system of FIG. 1.
Figure 5:
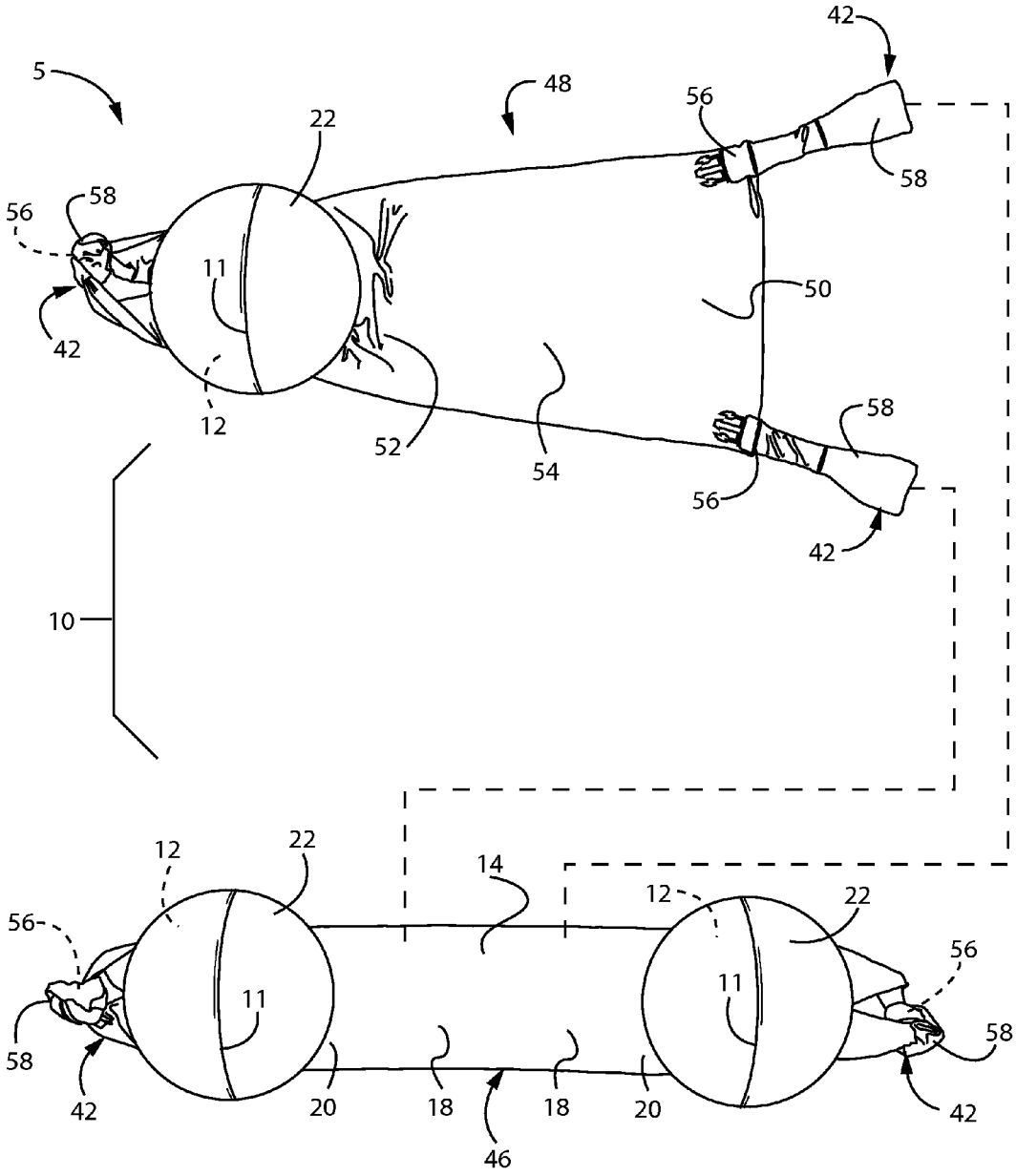
FIG. 5 is an exploded top plan view of the recreational buoyancy system of FIG. 2.

Referring now to FIGS. 4 and 5, the user supports 10 are substantially the same as those shown in FIGS. 1-3 but differing in the following ways. Unlike the unitary user support(s) 10 with continuously closed perimeter loops 42 as shown in FIGS. 2 and 3, the user support(s) 10 shown in FIGS. 4 and 5 have multiple components and/or loops 42 that can be selectively opened, as described in greater detail elsewhere herein.

Still referring to FIGS. 4 and 5, the user support 10 is defined by multiple components that are detachably connected to each other, shown as a tether 46 and a sling 48 that can removably attach to the tether 46. Referring now to FIG. 5, the sling 48 includes first and second ends 50, 52 and an intermediate segment 54 extending between the first and second ends 50, 52. In a resting state, the intermediate segment 54 defines a flat panel of material that has a generally triangular perimeter shape. The intermediate segment 54 tapers down from the relatively wider first end 50 to the relatively narrower second end 52. The first end 50 includes at least one loop 42 and is shown in this embodiment as having a pair of loops 42, each of which can be opened and is shown in the open position. The second end 52 has a loop 42 that can be opened and is shown in the closed position.

Still referring to FIG. 5, each of the loops 42 includes a connector 56 that allows the loop 42 to be broken or disconnected. The connector 56 may have multiple interconnecting segments and be a buckle, clasp, clip, hook and loop fastener, zipper, and/or other suitable connecting device(s). Covers 58 are provided to cover the connectors 56 when desired. Each cover 58 is a sleeve of fabric or other material, preferably, the same material from which the rest of the user support 10 is made. The cover 58 may be attached to the loop 42 at one end and unattached at the other end. This allows the cover 58 to be slid down over and cover the connector 56 when the system 5 is being used and slid up past the connector 56 so that the connector is exposed when the system 5 is not in use. When the connector 56 is exposed, the loop 42 can be opened or disconnected and then slid through or around other portions of the system 5 and reclosed to connect the loop 42 to such other portion(s) of the system 5. For example, the loops 42 at the first end 50 of the sling 48 may be opened, extended around the tether 46, and then reclosed as loops 42 around the tether 46 so as to connect the sling 48 to the tether 46.

Still referring to FIG. 5, the tether 46 of FIG. 5 is substantially the same as the user support 10 shown in FIG. 2 with a pair of floats 12. The difference is that the tether 46 of FIG. 5 has loops 42 that can be opened like those discussed above with respect to the sling 48.

In light of the above, to use the system 5, the floats 12 may be installed in the pockets 22 by inserting the deflated floats 12 through the openings 38 and into the spaces 36 of the pockets 22. An inflation needle of the pump may be inserted through the openings 38 and into the air inlet 13B and the pump may be used to inflate the floats 12 to a desired size to provide a desired amount of buoyancy. The flap 40 may be closed to prevent access through the opening 38 so as to maintain the floats 12 in the spaces 36 of the pockets 22.

The user support 10 may be wrapped around portions of the user or the user may lie against the user support 10 so as to buoyantly support or suspend the user under water, for example, with the user's neck and head above water. A two float 12 embodiment, such as the user support 10 shown in FIG. 2 and the sling 48 shown in FIG. 5, may be used alone. A user may insert his or her fingers and/or hands into the loops 42 and use the loops 42 as handles to hang on to the user support 10 and also for positioning the floats 12 and thus also for positioning the user support 10 in a desired position in front of or behind the user's torso, adjacent his or her shoulders. The intermediate portion 14 or one of the arms 16 may be sandwiched between the user's arms and torso, if desired. Optionally, the user support 10 may support a user's lower body by, for example, holding the intermediate portion 14 between the user's legs.

In a three float 12 embodiment, such as the user support 10 shown in FIG. 3 or the user support 10 defined by the combined tether 46 and sling 48 shown in FIG. 5, one of the arms 16 may be positioned between the user's legs, with its float 12 either in front or in back of the user. This can be done while other arms 16 and floats 12 are supporting the upper body of the user, or otherwise. Yet other supporting positions can be achieved, as desired, by the user. That is because the arms 16 may define a generally rectangular or straight perimeter shapes, Y-shaped perimeters, T-shaped perimeters, X-shaped perimeters, and other perimeter shapes that have multiple floats 12 that can move with respect to each other and are interconnected with flexible materials.

It is further noted that the user support 10 does not have to support a person, per se. In some embodiments, the user support 10 buoyantly supports an object(s) that is being utilized by the user during recreational water use. In one such embodiment, the system 5 is configured with the user support 10 defining a net-like or other sheet that can substantially encapsulate an object. For example, the user support 10 may cradle and/or capture and hold any of a variety of objects such as, e.g., a cooler, beverage containers, personal accessories, sporting goods, and/or other accessories. In some such embodiments, the user support 10 may include a drawstring (not shown) or other closure mechanism that can draw the floats 12 toward and hold them against each other to seal the object and/or other contents in the user support 10. Such object-carrying version of the user support 10 may be towed behind a boat or raft; optionally, may be interconnected with a version of the user support 10 that is supporting a person, so that it can be towed thereby or remain in close proximity thereto. In another embodiment, the buoyancy system would include four or more floats 12 that provide sufficient buoyancy collectively to allow the user to sit or lie in between the floats 12 while the head and shoulders may be buoyantly supported above the water. In another embodiment, at least one of the pockets 22 holds two or more floats 12. With two or more floats 12, which may be relatively smaller than the single float 12 per pocket 22 versions, the multiple floats 12 may provide a concavity in the materials of the pocket 22 around them. This may accommodate supporting a head of the user while lying back and which may conform to the shape of the head of the user due to the flexible and/or stretchy characteristics of the material from which the pocket 22 is made. The float 12 and at least one of the pockets 22 may have a cylindrical or crescent shape so as to provide a pillow-type head-supporting configuration of the float 12.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A recreational buoyancy system, comprising:

multiple floats that are spaced from each other, each of the multiple floats being buoyant so as to float in water; and a user support that can engage a body of a user and that extends between and connects the multiple floats to each other, the user support having an intermediate portion and multiple arms that extend from the intermediate portion in different directions toward outer ends of the multiple arms so that the multiple floats are arranged at the outer ends of the multiple arms, respectively, wherein the user support is made from a flexible material so that the user support can conform to the body of the user while the multiple floats buoyantly support the user in the water at spaced-apart locations while allowing the multiple floats to move relative to each other;

wherein the material of the user support is flat in cross-section and can bend along multiple axes so as to conform to the body of the user;

wherein the user support includes an upper layer and a lower layer, each of which is made from a flexible material, the upper layer including an upper surface that engages the body of the user and an opposing lower surface, the lower layer including an upper surface that abuts the lower surface of the upper layer and an opposing lower surface that faces away from the user;

wherein each of the multiple arms includes a pocket that holds a respective one of the multiple floats.

2. The recreational buoyancy system of claim 1 wherein at each of the pockets, at least portions of the upper and lower layers of the user support are spaced from each other at the pocket to define a space therebetween and wherein the respective float is arranged within the space between the upper and lower layers of the user support at the pocket.

3. The recreational buoyancy system of claim 2 further comprising a loop that can be grasped by a hand of the user that is arranged at one of the pockets.

4. The recreational buoyancy system of claim 3 wherein multiple loops that can be grasped by hand of the user are arranged at the multiple pockets, respectively.

5. The recreational buoyancy system of claim 4 wherein the multiple loops are arranged at outer portions of the pockets so that each float is arranged between the respective loop and arm.

6. The recreational buoyancy system of claim 1 wherein each of the multiple floats has a variable volume for changing size of the float.

7. The recreational buoyancy system of claim 6 wherein each of the multiple floats is pneumatically inflatable.

8. The recreational buoyancy system of claim 7 wherein each of the multiple floats is spherical.

9. The recreational buoyancy system of claim 1 wherein the user support is relatively less buoyant than the multiple floats so that the intermediate portion of the user support hangs below the multiple floats.

10. A recreational buoyancy system, comprising:

multiple floats that are spaced from each other, each of the multiple floats being buoyant so as to float in water; and a user support that can engage a body of a user and that extends between and connects the multiple floats to each other, the user support having an intermediate portion and multiple arms that extend from the intermediate portion in different directions toward outer ends of the multiple arms so that the multiple floats are arranged at the outer ends of the multiple arms, respectively, wherein the user support is made from a flexible material so that the user support can conform to the body of the user while the multiple floats buoyantly support the user in the water at spaced-apart locations while allowing the multiple floats to move relative to each other;

wherein the material of the user support is flat in cross-section and can bend along multiple axes so as to conform to the body of the user;

wherein each of the multiple floats has a variable volume for changing size of the float;

wherein each of the multiple floats is pneumatically inflatable; and wherein each of the multiple arms includes a pocket that holds a respective one of the multiple floats and each of the multiple floats includes an air inlet for receiving air to increase the size of the float, each pocket including an opening that can be aligned with the air inlet of the respective float for permitting access to the air inlet.

11. A recreational buoyancy system, comprising:

multiple floats that are spaced from each other, each of the multiple floats being buoyant so as to float in water; and a user support that can engage a body of a user and that extends between and connects the multiple floats to each other, the user support having an intermediate portion and multiple arms that extend from the intermediate portion indifferent directions toward outer ends of the multiple arms so that the multiple floats are arranged at the outer ends of the multiple arms, respectively, wherein the user support is made from a flexible material so that the user support can conform to the body of the user while the multiple floats buoyantly support the user in the water at spaced-apart locations while allowing the multiple floats to move relative to each other;

wherein the material of the user support is flat in cross-section and can bend along multiple axes so as to conform to the body of the user;

wherein each of the multiple floats has a variable volume for changing size of the float;

wherein each of the multiple floats is pneumatically inflatable; and wherein each of the multiple arms includes a pocket that holds a respective one of the multiple floats with each pocket defining an opening and a flap that overlies and selectively restricts access to the opening of the respective pocket.

12. The recreational buoyancy system of claim 9 wherein the user support is made from at least one of a nylon material, a spandex material, and a polyester material.

13. The recreational buoyancy system of claim 1, wherein the user support includes multiple segments that are removably attached to each other.

14. The recreational buoyancy system of claim 1 wherein the arms are defined at the multiple segments that are removably attached to each other.

15. A recreational buoyancy system, comprising:

multiple floats that are spaced from each other, each of the multiple floats being buoyant so as to float in water; and a user support that can engage a body of a user and that extends between and connects the multiple floats to each other, the user support having an intermediate portion and multiple arms that extend from the intermediate portion in different directions toward outer ends of the multiple arms so that the multiple floats are arranged at the outer ends of the multiple arms, respectively, wherein the user support is made from a flexible material so that the user support can conform to the body of the user while the multiple floats buoyantly support the user in the water at spaced-apart locations while allowing the multiple floats to move relative to each other; and wherein the user support includes a tether that extends between a first float and a second float and a sling that extends between the tether and a third float.

* * * * *

UNITED STATES PATENT AND TRADEMARK OFFICE

CERTIFICATE OF CORRECTION

PATENT NO. : 9,017,127 B1
APPLICATION NO. : 13/644292
DATED : April 28, 2015
INVENTOR(S) : Brian M. Callahan and Daniel P. McGinley It is certified that error appears in the above-identified patent and that said Letters Patent is hereby corrected as shown below:

On the title page, at line 1 of the Applicants (71) section, please replace the middle initial "A" with -- M -- to change "Brian A. Callahan" to -- Brian M. Callahan --.

On the title page, at line 1 of Inventors (72) section, please replace the middle initial "A" with -- M -- to change "Brian A. Callahan" to -- Brian M. Callahan --.

Signed and Sealed this
First Day of September, 2015

Michelle K. Lee

Michelle K. Lee
*Director of the United States Patent and Trademark Office*